US006068515A

United States Patent [19]

Embo et al.

[11] Patent Number: 6,068,515

[45] Date of Patent: May 30, 2000

[54] EQUIPMENT PLUG CONNECTOR FOR A STACK OF CARDSHAPED DATA CARRIER ARRANGEMENTS

[76] Inventors: Georges Embo, Bilkschotestrasse 100, B-8920 Langemark, Belgium; Peter Preiner, Noestrasse 20, D-81479 München; Helge Schmidt, Am Woogbach 33, D-67346 Speyer, both of Germany

[21] Appl. No.: 08/941,382

[22] Filed: Sep. 30, 1997

Related U.S. Application Data

[63] Continuation of application No. PCT/DE96/00498, Mar. 22, 1996.

[30] Foreign Application Priority Data

Mar. 31, 1995 [DE] Germany ..... 195 12 169

[51] Int. Cl.[7] ..... H01R 23/70

[52] U.S. Cl. ..... 439/631

[58] Field of Search ..... 439/262, 631, 439/637

[56] References Cited

U.S. PATENT DOCUMENTS 4,220,382 9/1980 Ritchie ..... 439/631
5,399,105 3/1995 Kaufman et al. .

FOREIGN PATENT DOCUMENTS 32 20 943 A1 1/1983 Germany .
44 35 122 C1 3/1996 Germany .

OTHER PUBLICATIONS

"Method for Providing EMC Protection to a Backplane With Exposed Edges", IBM Technical Disclosure Bulletin, vol. 3, No. 6A, Nov. 1990.

"Area Array Elastomeric Interconnect Fabricated with Flex", IBM Technical Disclosure Bulletin, vol. 36, No. 3, Mar. 1, 1993.

*Primary Examiner*—Steven L. Stephan
*Assistant Examiner*—Javaid Nasri

[57] ABSTRACT

An equipment plug connector for a stack of cardshaped data carrier arrangements mutually superimposed in-register with regard to at least one of the surfaces thereof and, respectively, having at least one integrated semiconductor circuit and at least one external connection connected thereto, includes a housing made of insulating material and formed with an opening for inserting a stack of cardshaped data carrier arrangements therein in an insertion direction perpendicular to a direction in which the stack is stacked, electrical connections of the equipment plug connector disposed in the housing, a plurality of contact springs arranged in the housing so as to extend in the stack insertion direction towards the opening formed in the housing for establishing an electrical connection between an exposed contact surface formed on the at least one external connection of the stack of cardshaped data carrier arrangements inserted into the equipment plug connector and the electrical connections of the equipment plug connector.

3 Claims, 2 Drawing Sheets

Fig. 3a
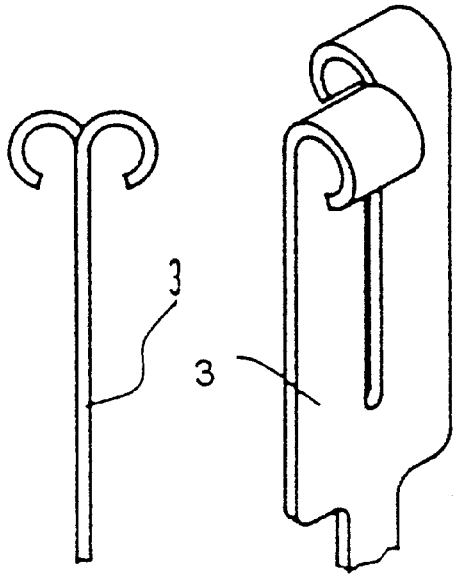
Fig. 3b
Fig. 4a
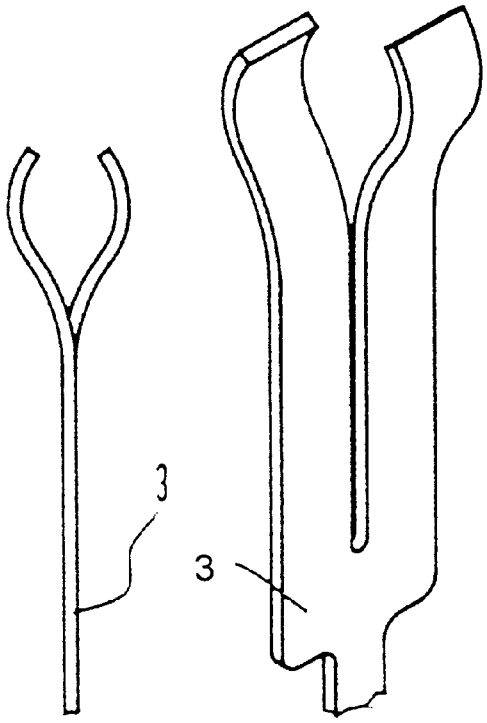
Fig. 4b

EQUIPMENT PLUG CONNECTOR FOR A STACK OF CARDSHAPED DATA CARRIER ARRANGEMENTS

CROSS-REFERENCE TO RELATED APPLICATION

This application is a continuation of International Application Ser. No. PCT/DE96/00498 filed Mar. 22, 1996.

BACKGROUND OF THE INVENTION

FIELD OF THE INVENTION

The invention relates to an equipment plug connector for a stack of cardshaped data carrier arrangements, which are mutually superimposed congruently or in-register with regard to at least one of the edge surfaces thereof and, respectively, have at least one integrated semiconductor circuit and at least one external connection connected thereto.

An equipment plug connector for a stack of data carrier arrangements of this general type has already been described in U. S. patent application Ser. No. 08/828,697 filed Mar. 31, 1997, a date which is later than the International priority date of Mar. 31, 1995 claimed for the instant application and consequently not prior art thereto, and is assigned to the same corporate assignee as that of the instant patent application. However, U.S. patent application Ser. No. 08/828,697 only discloses stackable cards in which the external connection has a connection surface arranged in one of the edge surfaces of the card. This arrangement enables a plurality of such cards to be placed one on the other without any problems, so that a multiplicity of identical data carrier arrangements can be connected simultaneously to a processing device without any complicated additionally auxiliary devices. For the case wherein the connection surfaces are respectively arranged only on the edge surface or, in other words, do not continue around the edges to the main surfaces of the card, it is proposed that the contact to be made between the connections be affected via a contact bar in a corresponding connecting socket. This socket can be arranged, for example, in an access device, but it can also be operated freely as a connecting socket.

SUMMARY OF THE INVENTION

It is accordingly an object of the invention to provide an equipment plug connector of the type mentioned in the introduction hereto which, in the case of a card stack wherein external connections of the cards, respectively, are not arranged areally or in a planar manner in an edge surface of the cards, but rather, wherein the external connections, respectively, project as contact blades from the edge surfaces, the cards of the stack being, in other words, not connected initially to one another in the stack, permits the individual cards of the stack to be connected to a common data bus only in the equipment plug connector.

With the foregoing and other objects in view, there is provided, in accordance with the invention, an equipment plug connector for a stack of cardshaped data carrier arrangements mutually superimposed in-register with regard to at least one of the edge surfaces thereof and, respectively, having at least one integrated semiconductor circuit and at least one external connection connected thereto, comprising a housing made of insulating material and formed with an opening for inserting a stack of cardshaped data carrier arrangements therein in an insertion direction perpendicular to a direction in which the stack is stacked, electrical connections of the equipment plug connector disposed in the housing, a plurality of contact springs arranged in the housing so as to extend in the stack insertion direction towards the opening formed in the housing for establishing an electrical connection between an exposed contact surface formed on the at least one external connection of the stack of cardshaped data carrier arrangements inserted into the equipment plug connector and the electrical connections of the equipment plug connector. In accordance with another feature of the invention, respective ends of the contact springs proximal to the contact surface are flexible and deformable and are located adjacent to one another, the adjacent ends forming a continuous contact column connected to the electrical connections of the equipment connector when at least one cardshaped data carrier arrangement is inserted into the housing.

In accordance with a further feature of the invention, the adjacent ends of the contact springs are fixed in the interior of the housing and are electrically connected to one another. In accordance with a concomitant feature of the invention, the cardshaped data carrier arrangements, respectively, have a plurality of parallel contact surfaces arranged regularly adjacent to one another, so that the external connections in the stack of cardshaped data carrier arrangements mutually corresponding thereto are arranged above one another in column form, and the contact springs in the equipment connector are interconnected and are accordingly arranged, like the external connections, above one another in column form.

Other features which are considered as characteristic for the invention are set forth in the appended claims.

Although the invention is illustrated and described herein as embodied in an equipment plug connector for a cardshaped stack of data carrier arrangements, it is nevertheless not intended to be limited to the details shown, because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIGS. 3*a* and 3*b* are respective side elevational and perspective views of an end of one embodiment of a spring contact located at the contact surface side in a respective equipment plug connector; and FIGS. 4*a* and 4*b* are views like those of FIGS. 3*a* and 3*b* of an end of another embodiment of the spring contact.

DESCRIPTION OF THE PREFERRED EMBODIMENTS

Figure 1:
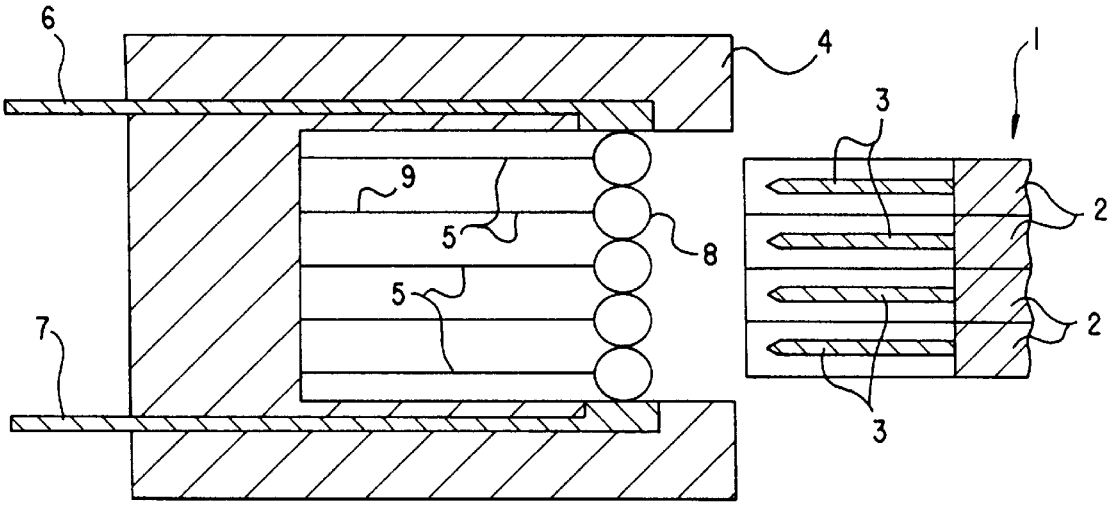
FIG. 1 is a fragmentary longitudinal or axial sectional view of a stack of cardshaped data carrier arrangements and an equipment plug connector shown at the beginning of an insertion operation.

Referring now to the drawings and, first, particularly to FIG. 1 thereof, there is shown in a right-hand part thereof a stack 1 of four cards 2. In an end region of the cards, respective recesses are provided in the card material, so that contact surfaces 3 formed as tongues or pins are, in fact, arranged freely on the respective card, however, the arrangement is not unprotected. In the context of the invention of the instant application, this construction is at least as uncritical as the integral construction of the contact blade with the lead frame (stamped circuit board) whereon the semiconductor circuits are mechanically fixed and electrically connected.

In the left-hand part of FIG. 1, there is illustrated a housing for the equipment plug connector formed of insulating material and open in the insertion direction. The contact springs 5 fixed in the interior of the housing 4 are indicated diagrammatically. It is advantageous to form those ends 8 of the contact springs 5 which are on the contact surface side to be flexible and deformable, so that the adjacent ends 8 form a continuous contact column connected to the connections 6 and 7 of the equipment plug connector, if at least one data cardshaped carrier arrangement 2 is inserted. Accordingly, with this construction, functioning is assured also when only one card is inserted. The connections 6 and 7 of the equipment connector can be formed, for example, as soldered connections which establish contact with a printed circuit board. In addition or as an alternative, the connection of one card to the next can also be effected by the electrical connection ("loop through or feed through") to one another of those ends 9 of adjacent contact springs 5 which are fixed in the interior of the housing 4.

Figure 2:
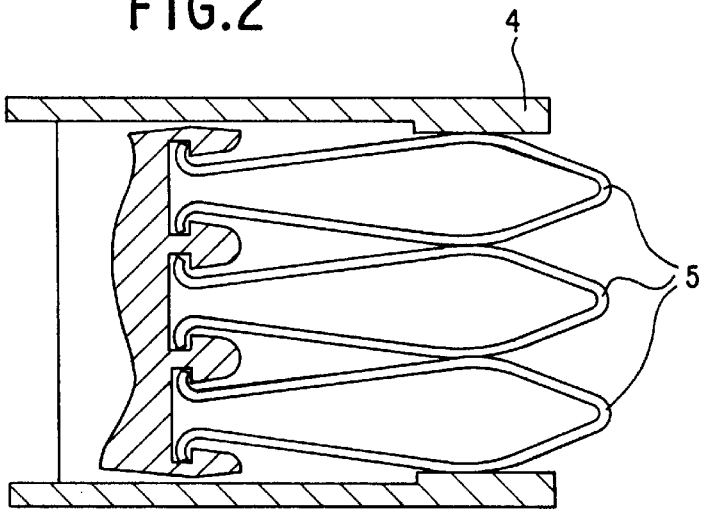
FIG. 2 is a sectional view, rotated through 90°, of another embodiment of the equipment connector.

FIGS. 2, 3 and 4 show special constructions of contact springs 5 which are flexible and deformable at the ends 8 thereof and are particularly suitable for receiving therebetween contact surfaces 3 in the form of tongues. Deformability upwards and downwards in the stack direction is provided in the illustrated constructions.

The cards normally have a plurality, usually eight are presently customary, of parallel contact surfaces which are arranged regularly next to one another. Due to the regular spacings, it is possible for the mutually corresponding external connections in the card stack 1 to be arranged one above the other in column form and for the interconnected contact springs 5 in the equipment plug connector accordingly likewise to be arranged one above the other in a column form. For example, eight columns of this type can accordingly be arranged next to one another in the equipment plug connector. The interconnected corresponding external connections of a plurality of cards lying one above the other and inserted jointly as a stack into the equipment plug connector consequently form a bus system, so that access to all the cards of the stack by a control device or a processing device, as is described in more detail in the aformentioned co-pending U.S. patent application Ser. No. 08/828,697 filed Mar. 31, 1997, can be effected with the aid of a single equipment plug connector.

If desired or necessary, the cards of the stack can lie above one another so that they are congruent or in-register only by the respective edge thereof on which the contact surfaces provided for electrically conductive contact-making are arranged. It is thus possible, for example, to alternate half and whole cards in the stack. Dummy cards or bus amplifier cards can likewise be inserted into the stack.

We claim:

1. An equipment plug connector for inserting a stack of cardshaped data carrier arrangements, each data carrier arrangement having at least one integrated semiconductor circuit and at least one external connection connected thereto, the plug connector comprising:

a housing made of insulating material and formed with an opening having an insertion direction perpendicular to a direction in which the stack is stacked for inserting the stack of cardshaped data carrier arrangements therein;

electrical connections disposed in said housing; and a plurality of contact springs disposed in said housing so as to extend in said insertion direction towards said opening formed in said housing for establishing an electrical connection between an exposed contact surface formed on the at least one external connection of the stack of cardshaped data carrier arrangements inserted into the equipment plug connector and said electrical connections of said equipment plug connector;

said contact springs having respective ends proximal to said contact surface, said respective ends being flexible, deformable, and located adjacent one another, said adjacent ends forming a continuous contact column connected to said electrical connections of the equipment connector when at least one cardshaped data carrier arrangement is inserted into said housing.

2. The equipment plug connector according to claim 1, wherein said adjacent ends of said contact springs are fixed in the interior of said housing and are electrically connected to one another.

3. The equipment plug connector according to claim 1, wherein the cardshaped data carrier arrangements, respectively, have a plurality of parallel contact surfaces arranged regularly adjacent to one another, so that the external connections in the stack of cardshaped data carrier arrangements mutually corresponding thereto are arranged above one another in column form, and said contact springs in the equipment connector are interconnected and are accordingly arranged, like the external connections, above one another in column form.

* * * * *